US005244450A

United States Patent [19]

Koehn

[11] Patent Number: 5,244,450

[45] Date of Patent: Sep. 14, 1993

[54] PROCESS OF MAKING BLOCKS OF BAGS

[75] Inventor: Uwe Koehn, Osnabrück, Fed. Rep. of Germany

[73] Assignee: Windmöller & Hölscher, Lengerich, Fed. Rep. of Germany

[21] Appl. No.: 902,726

[22] Filed: Jun. 23, 1992

[30] Foreign Application Priority Data

Jun. 24, 1991 [DE] Fed. Rep. of Germany ..... 4120802
Jul. 22, 1991 [DE] Fed. Rep. of Germany ..... 4124288

[51] Int. Cl.[5] ..... B31B 1/14

[52] U.S. Cl. ..... 493/195; 493/196; 493/200; 493/201; 493/238; 493/267; 493/363

[58] Field of Search ..... 493/194, 195, 196, 197, 493/198, 203, 200, 201, 238, 239, 267, 362, 363

[56] References Cited

U.S. PATENT DOCUMENTS

| | | | |
|---|---|---|---|
| 3,372,625 | 3/1968 | Simecek | 493/194 |
| 3,893,382 | 7/1975 | Bosse | 493/194 |
| 4,285,681 | 8/1981 | Walitalo | 493/194 |
| 4,785,696 | 11/1988 | Martiny | 493/362 |
| 4,983,155 | 1/1991 | Stobb | 493/361 |

*Primary Examiner*—Bruce M. Kisliuk

*Assistant Examiner*—Jack Lavinder

*Attorney, Agent, or Firm*—Keck, Mahin & Cate

[57] ABSTRACT

To make blocks of bags having blocked stubs, which are joined by perforation lines substantially only to the lower opening-defining edge of each block, which lower edge is separated by a substantially continuous slit from the upper opening-defining edge, a tubular web of synthetic thermoplastic material is formed in partial regions with perforation lines extending through both plies. Only the upper ply is cut to form separating slits extending substantially throughout the width of that upper ply. The bags are then separated from the tubular web by hot-wire welding and are stacked. To make blocks of bags in which each bag is joined only at its rear wall to the stub, which serves to stack and retain the bag, transverse perforation lines consisting of holes or slits are formed in the upper ply at the opening-defining edges of the bags to be formed, and both plies are subsequently formed with transverse perforation slits, which are so offset that over the width of the initially formed perforation holes the upper ply is entirely separated from the stub and the lower ply is joined to the stub by lands adjacent to the initially formed overlying perforation line.

4 Claims, 5 Drawing Sheets

PROCESS OF MAKING BLOCKS OF BAGS

BACKGROUND OF THE INVENTION

1. Field of the Invention

This invention relates to a process of making blocks of bags, which have preferably blocked stubs, which are joined by perforation lines substantially only at the bottom opening-definingedges ofthe individual bags whereas they are separated from the top opening-defining edges by a substantially continuous slit, wherein a tubular film of synthetic thermoplastic is provided in partial regions with perforation holes extending through both plies and slits extending substantially over the width are formed only in the upper ply, whereafter the bags are severed from the tubular film by hot-wire welding and are stacked.

2. Description of the Prior Art

German Utility Model 89 15 077.5 discloses blocks of bags which are joined to stubs by a perforation line only at the bottom wall of each bag and the bags are held together in ablock of bags at said stubs by means of stacking pins or staples, whereas the opening-defining edges of the top plies of the bags terminate in front of the perforation lines defining the stubs. In such blocks of bags the currently uppermost bag of each stack can be opened by an air stream blown into the bag so that objects to be packaged in the bag, such as bread, can be pushed into the bag and that pushing will also cause the bag to be torn off along the transverse perforation line from the stack holder and from the stub. Similar blocks of bags can be made by a process which will be described hereinafter with reference to FIG. 1 of the drawing. A flat web 1 is reversely folded to form a doubled web 2, which is formed with a bottom fold 3 in known manner. To that end the bottom ply of the flat web 1 is reversely folded so that the two edges 4 and 5 are offset from each other and a top edge strip 6 is left exposed. That exposed strip is formed with suspension holes 7. Adjacent to said suspension holes the strip 6 has slits 6, which extend inwardly from the outside and terminate short of the suspension holes 7. The individual bags are then severed by slits 9 made by hot-wire welding and are subsequently combined by known means to form a block of bags 10. Wire loops 11 are inserted through the suspension holes 7 and plugs 12 are slidably fitted on the free ends of the legs of each wire loop. Such block of bags differ from the one disclosed in the above-mentioned German Utility Model 89 15 077 in that the top strips, which serve to retain and stack the bags, are also torn off when the individual blocks are torn off.

Published German Patent Application 36 37 231 discloses a process of making blocks of bags of the kind described first hereinbefore. A special problem arising in such process resides in that it is difficult to form only the bottom or ply, which will form the rear walls of the bags, with transverse perforation lines joining the bags of the stack to the stubs whereas the top plies, which in the stack constitute the forward walls of the bags are entirely or almost entirely separated by transverse slits from the tubs, which serve to stack and retain the bags. Because the front walls of the bags are separated from the stubs, the currently uppermost bag of a stack can subsequently be opened, e.g., by being inflated, when the bag is to be filled.

SUMMARY OF THE INVENTION

It is an object of the invention to provide a process which is of the kind described first hereinbefore and which permits a simple making of blocks of bags which only by their rear walls are joined to the stubs serving to stack and retain the bags.

In a process of the kind described first hereinbefore that object is accomplished in accordance with the invention in that transverse perforation lines are formed in the top ply at locations corresponding to the opening-defining edges of the bags to be made, and the two plies are subsequently formed with transverse perforation slits, which are so offset that the top ply is entirely separated from the stub over the width of the initially formed perforation line and that the bottom ply is joined to the stub by lands adjacent to the overlying perforation holes which have initially been formed. In the process in accordance with the invention the transverse slits, which define only the top opening-defining edges of the stacked bags, and the transverse perforation lines, which join the bags to the stubs and are formed only in the rear walls of the bags, can be made in a simple manner in two steps in that in a first step only the top ply is formed with a transverse perforation line and in a succeeding second step a tool which cuts through both plies is used to form the web with perforation slits along a transverse line in such a manner that the slits extend through the lands of the first perforation line and the bottom ply is formed at the same time with a transverse perforation line having lands adjacent to the holes of the transverse perforation line formed in the top ply in the first step.

Bags provided with side gussets can be substantially completely filled to form an approximately parallelepipedic package. For this reason a further feature of the invention resides in that the marginal portions of the tubular web are formed in both plies with holes or slits and the tubular web is subsequently formed with side gussets in such a manner that the holes or slits extend only in the superimposed inner walls of the gussets. In that manner it is possible to make blocks also from bags provided with side gussets; in such blocks each bag is separated from the stub by the second transverse slit extending through the perforation line in the front wall and in the side gussets so that only the rear walls of the bags and the side gusset portions lying in a plane with said rear wall are joined to the stubs. If slits rather than holes are die-cut into the marginal portions of the tubular web, the length of such slits will be equal to the diameter of the holes.

The process which has been described with reference to FIG. 1 has the disadvantage that it can be performed only as a single-web process so that expensive machinery is required for making blocks of bags at a relatively low production rate. In order to increase the production rate it is a further feature of the invention that a tubular web or doubled web is divided by hot-wire welding into narrower tubular webs, from which the blocks of bags are then made, in which the top walls of the bags are substantially separated from the stubs and only the bottom walls of the bags are joined by perforation lines to the stubs.

In addition to the process, protection is claimed also for blocks of bags made by the process.

BRIEF DESCRIPTION OF THE DRAWING

FIG, 1 is an illustration of a known process of makeing blocks of bags.

DETAILED DESCRIPTION OF THE PREFERRED EMBODIMENTS

Figure 1:
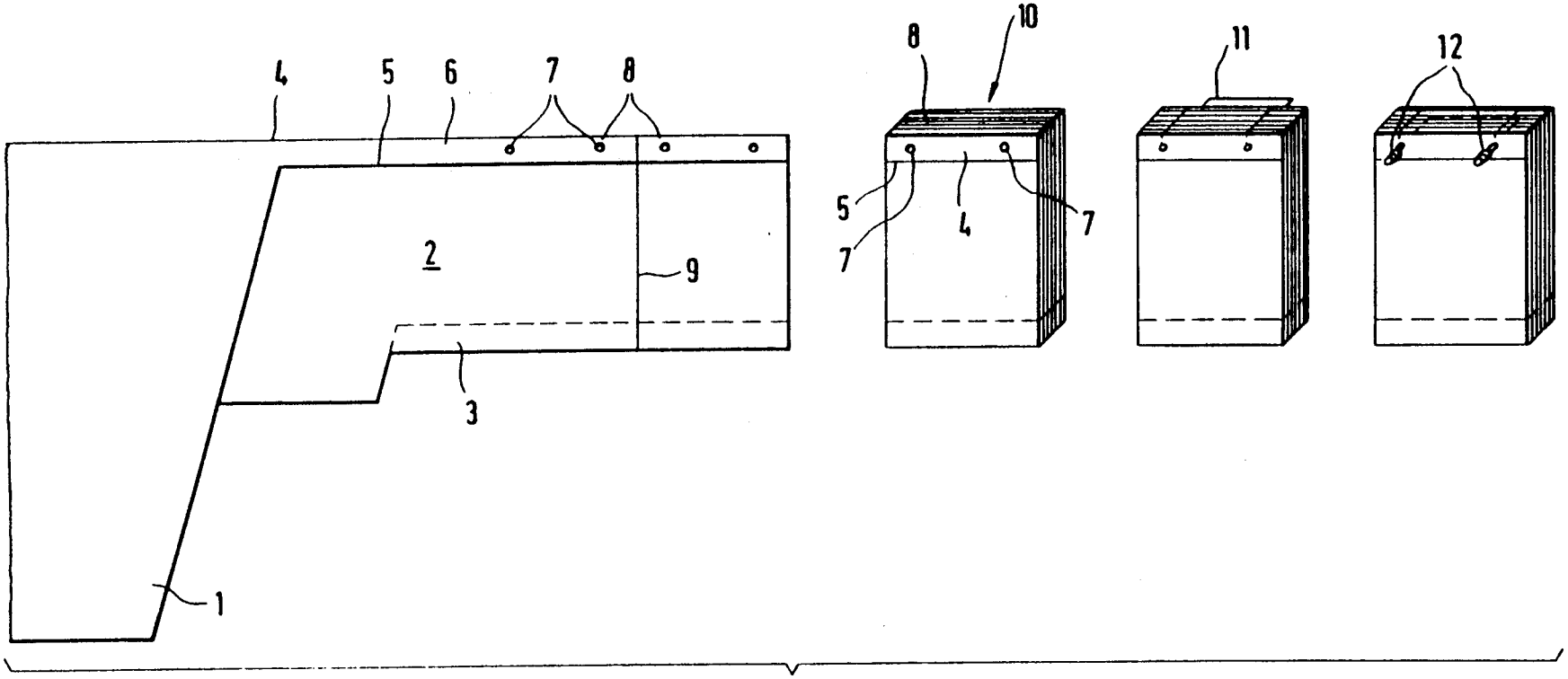

Illustrative embodiments of the invention will now be described more in detail with reference to FIGS. 2 to 6 of the drawing.

Figures 2, 3:
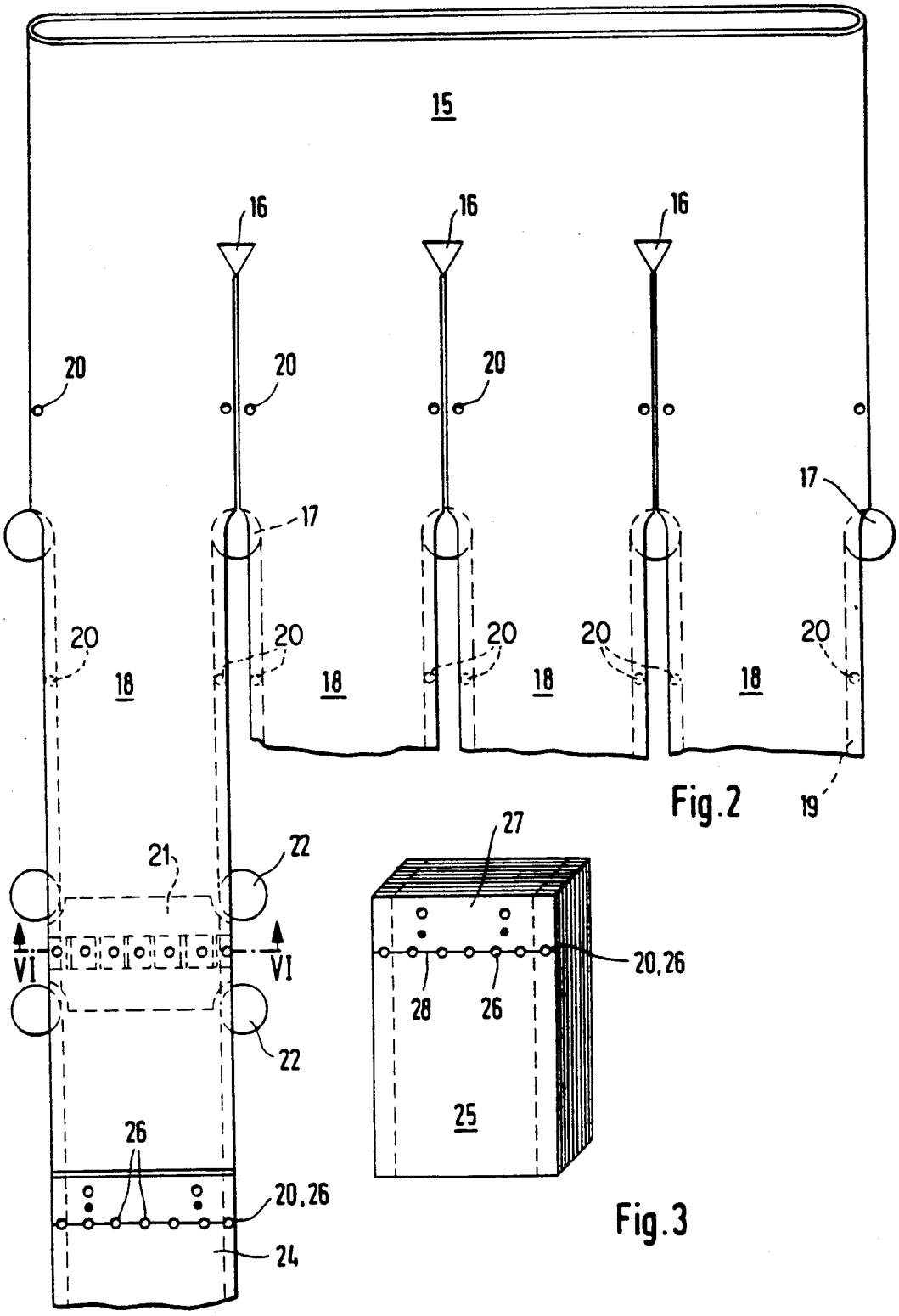
FIG. 2 is a top plan view showing a flattened tubular web for use in an illustrative embodiment of the process according to the invention. The tubular web has been divided by longitudinal slits made by hot-wire welding into four juxtaposed tubular webs, which are subsequently formed with side gussets and with die-cut holes and transverse perforation lines and are subsequently severed by hot-wire welding to form bags, which are stacked to form blocks of bags.
FIG. 3 is a perspective view showing a block of bags made by the process illustrated in FIG. 2.

FIG. 2 shows a flattened flexible tubing 15 of synthetic thermoplastics. That tubing is divided by hot-wire welders 16 into a plurality of parallel narrower flexible tubes. By the hot-wire welders 16 the tubular web 15 is divided by longitudinal slits and the cut edges are joined by welding at the same time. Means 17, which are not described in detail because they are known per se, are used to form side gussets in said narrower flexible tubes. Before the side gussets 19 are formed, the lateral marginal portions of each narrower flexible tube 18 is formed with die-cut holes 20, which extend through both plies. The spacing of said holes 20 is equal to the length of the bags to be made plus the width of the stubs provided for holding and stacking said bags. When the side gussets 19 have been formed, the holes 20 are no longer visible in a top plan view because they extend only through the inner walls of the side gussets 19.

Thereafter each flexible tube 18 is provided behind the gusseting means 17 with separators 21, which are retained by rollers 22 acting from the outside and open up the tubes. For the sake of simplicity that step in the process is illustrated only on the left-hand flexible tube 18. Separators 21, which are used to permit an exclusive processing of the top ply of a tubular web while leaving the bottom ply unprocessed, are known, e.g., from Published German Patent Application 24 43 448. For this reason the design, arrangement and retention of such separators are not described in detail because they are known per se.

Figure 4:
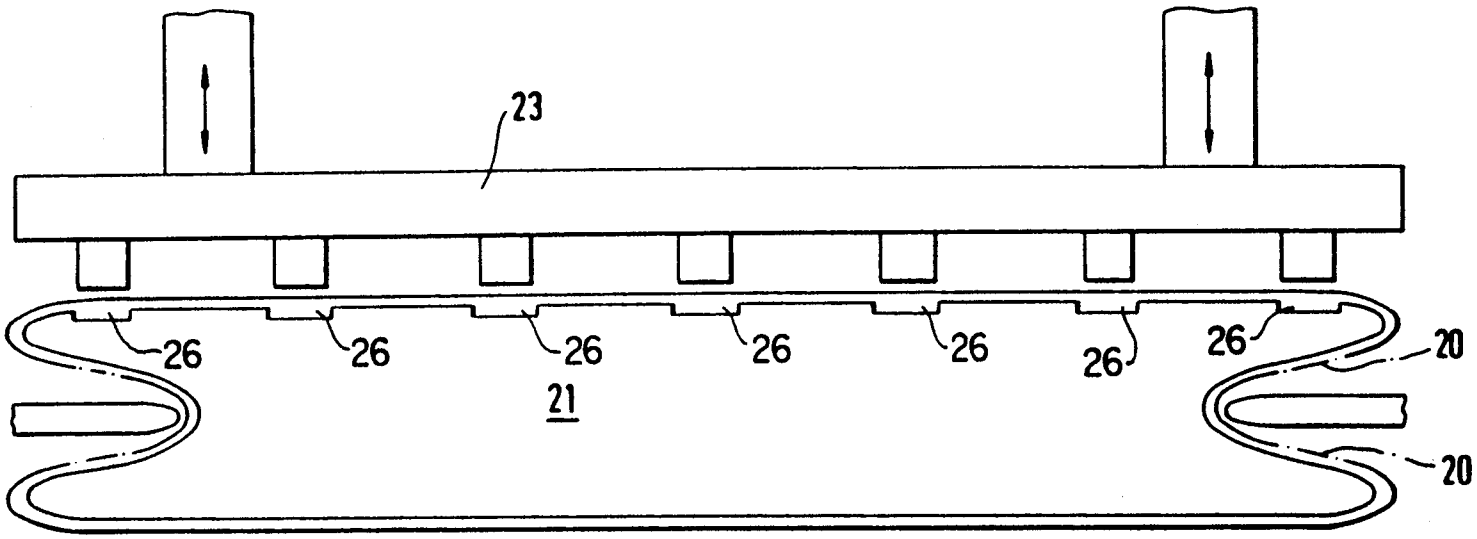
FIG. 4 is a transverse sectional view showing a web and a tool for forming the top ply of the web with die-cut holes disposed on a transverse line.

As is apparent from FIG. 4, a punching apparatus 23, not shown in FIG. 2, is then operated to form die-cut holes 26 in the top ply only of each flexible tube. The two outer holes are congruent with the previously formed die-cut holes 20 so that the top ply of the web and the inner walls of each side gusset 19 are formed with holes adjacent to the side gussets 19. Thereafter, individual bags 24 are severed from the thus processed gusseted tubing and are combined in a block of bags 25, e.g., by means of an apparatus which is known from Published German Patent Application 23 58 281. That published application discloses a perforating knife 17. In the process in accordance with the present invention, the perforating knife which cuts through both walls of each bag is so arranged that the knife perforates the bottom wall with transverse slits and at the same time forms aligned transverse slits 28 in the top wall which sever the lands between the holes 26, 20. As a result, the top wall of each bag and the two inner walls of each side gusset are separated by a continuous slit from the top stub 27, whereas the bottom wall of each bag is still joined to the bottom stub 27 by the transverse slits which form a perforation line. Because the transverse slits in the top wall connect with the series of holes 26, 20, the top wall will entirely be separated even in case of manufacturing inaccuracies because the partial cutters of the transverse perforating knife can easily be arranged so that the edges of the partial cutters are disposed in the edge regions of the previously formed die-cut holes.

Figure 5:
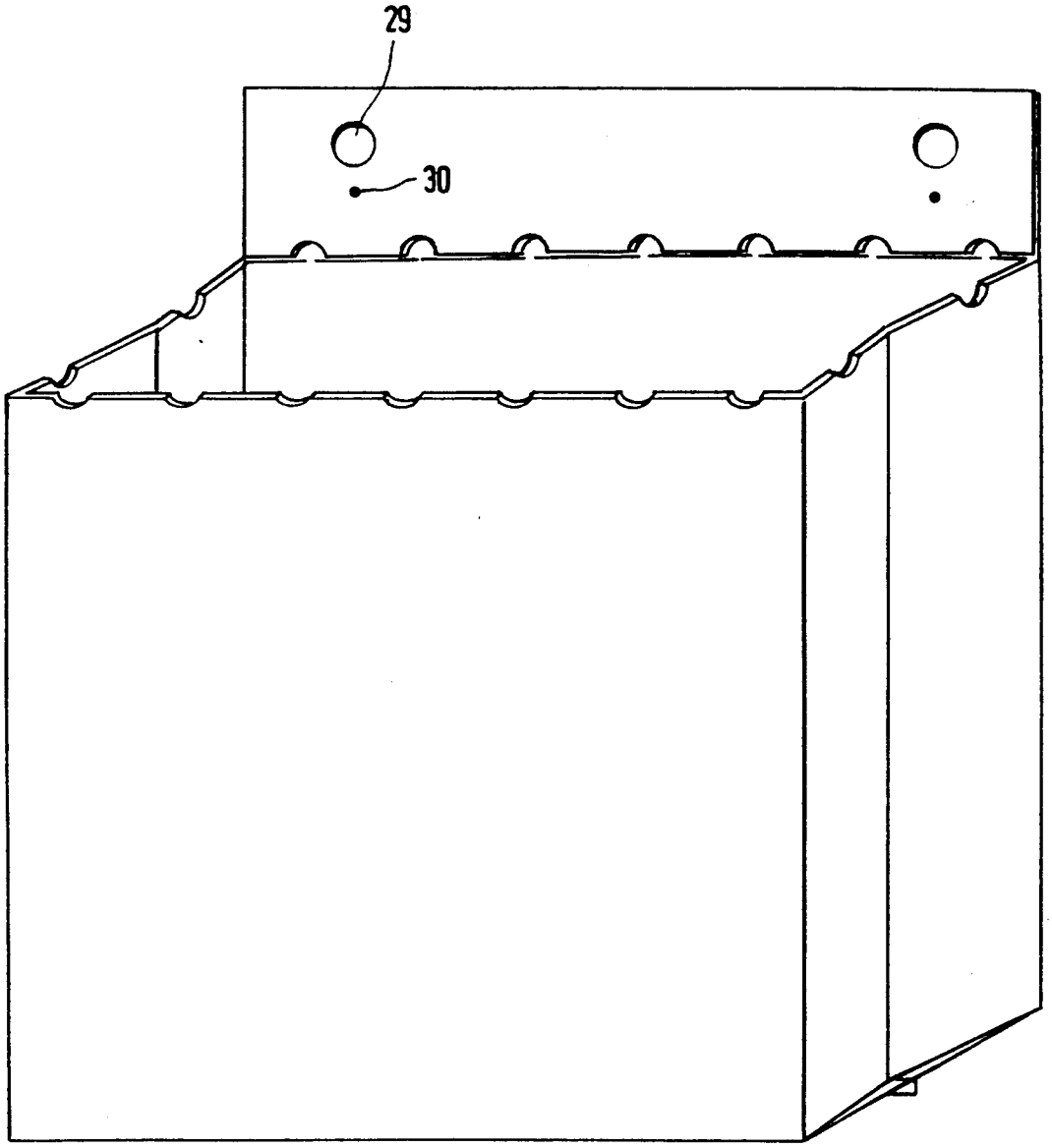
FIG. 5 is a perspective view showing a bag which has been made by the process according to the invention and has been opened.

When the currently uppermost bag of a stack of bags made as described hereinbefore is then inflated by a jet of air, an opened bag will be formed as is shown in FIG. 5.

The suspension holes 29 and the blocking spots 30 may also be provided by the apparatus which is known from Published German Patent Application 23 58 281.

Figure 6:
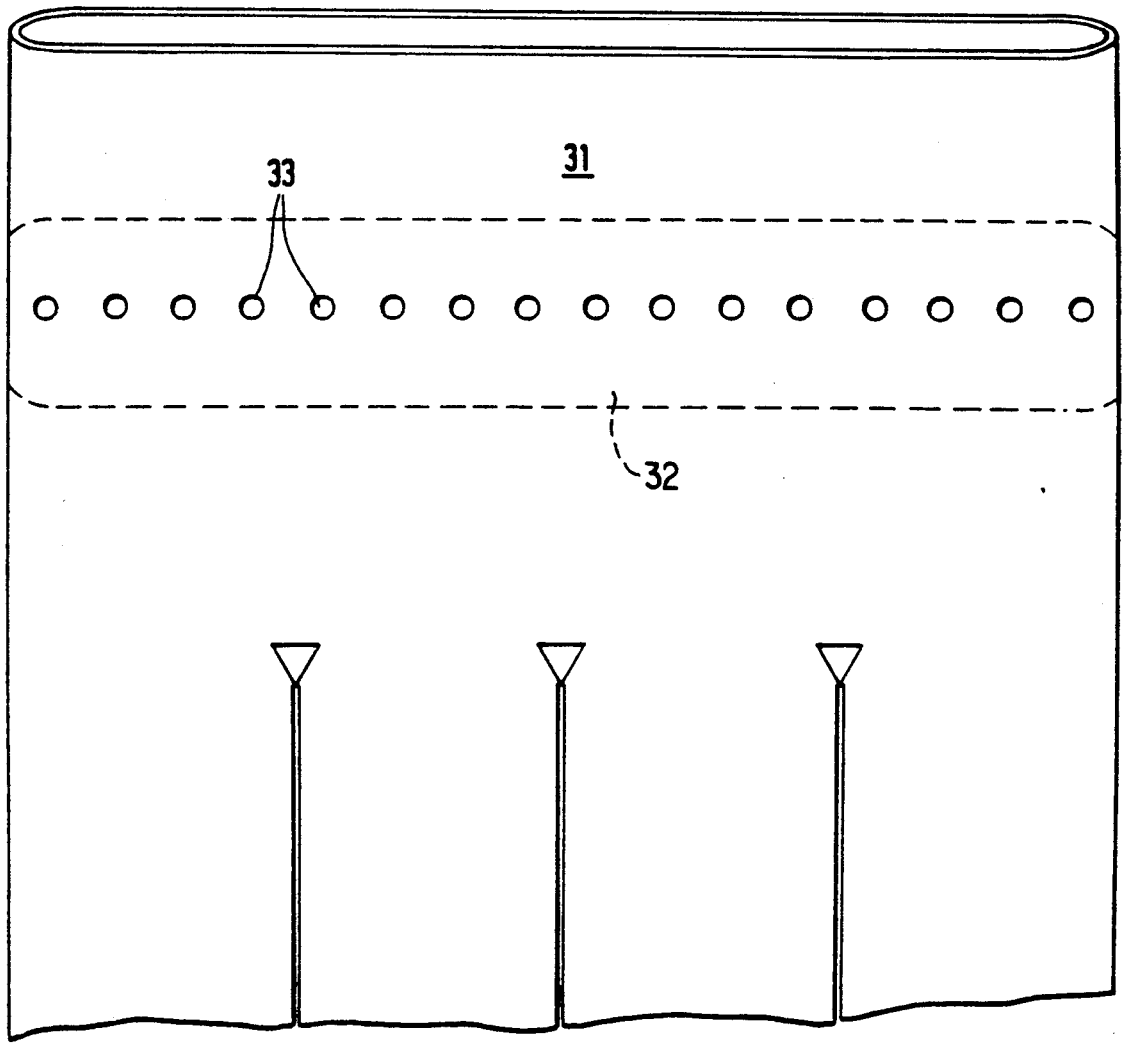
FIG. 6 is a view that is similar top to FIG. 2 and illustrates the making of blocks of bags having no side gussets.

A simplified process will now be described with reference to FIG. 6. That process can be used to make blocks of bags having no side gussets. In the process shown in FIG. 6, a separator 32 is inserted into a flattened tubular web 31, which is then formed in its top ply with a series of holes 33 or slits so that transverse perforation lines subsequently to be formed in both plies will sever the lands between the holes 33 of the top ply. When the top ply has been formed as described with the transverse perforation line consisting of the holes 39, the tubular web is divided as described into narrower flexible tubes by longitudinally extending cuts made by hot-wire welding. The bags provided with stubs are then severed from the narrower flexible tubes by hot-wire welding whereas side gussets are not formed in the flexible tubes.

I claim:

1. A method of making a bag which comprises providing a tube having a front wall and a back wall, forming a transverse row of spaced apertures in the front wall only of the tube at a location spaced from a transverse end of the tube, said location defining a top edge of the bag with tube material between said location and said transverse end defining a bag stub, then forming aligned transversely extending rows of slits in both the front and back walls of the tube at said location with the slits in the front wall extending into the respective apertures so as to separate the front wall from the bag stub while the back wall remains attached to the stub by a transverse perforation line defined by the slits in the back wall, for subsequent removal of the bag from the stub by tearing along said perforation line.

2. A method as claimed in claim 1, wherein the bag is stacked with other like bags to form a block of bags with aligned stubs and suspension apertures are formed in the stubs.

3. A method as claimed in claim 1, wherein opposite sides of the tube are formed with gussets and said apertures include at least one aperture in each gusset.

4. A method as claimed in claim 1, wherein said tube is formed by dividing a larger tube longitudinally into smaller tubes and sealing opposite edges of the smaller tubes.

* * * * *